US005220860A

United States Patent [19]

Rae

[11] Patent Number: 5,220,860

[45] Date of Patent: Jun. 22, 1993

[54] DIAPHRAGM VALVE FOR PERCUSSIVE APPARATUS

[75] Inventor: Ian D. Rae, Roanoke, Va.

[73] Assignee: Ingersoll-Rand Company, Woodcliff Lake, N.J.

[21] Appl. No.: 939,958

[22] Filed: Sep. 4, 1992

Related U.S. Application Data

[63] Continuation of Ser. No. 711,978, Jun. 7, 1991, abandoned.

[51] Int. Cl.[5] ..... F01L 25/04

[52] U.S. Cl. ..... 91/299; 91/317; 137/119

[58] Field of Search ..... 91/299, 317; 137/119, 137/859, 102; 173/13, 17, 112, 113

[56] References Cited

U.S. PATENT DOCUMENTS

| | | | |
|---|---|---|---|
| 2,151,694 | 3/1939 | Gartin . | |
| 2,459,484 | 1/1949 | Bancel et al. . | |
| 2,899,934 | 8/1959 | Salengro . | |
| 3,050,032 | 8/1962 | Carey . | |
| 3,068,890 | 12/1962 | Tamplen | 137/102 X |
| 3,770,012 | 11/1973 | Bitzer et al. | 137/119 X |
| 3,845,777 | 11/1974 | Gilson | 137/119 |
| 3,958,495 | 5/1976 | Bernhoft | 137/102 X |
| 3,974,885 | 8/1976 | Sudnishikov et al. . | |
| 4,173,984 | 11/1979 | Solomon | 137/119 |
| 4,446,773 | 5/1984 | Emonet | 91/317 |
| 4,461,204 | 7/1984 | Emonet | 91/317 X |

*Primary Examiner*—Edward K. Look
*Assistant Examiner*—Todd Mattingly
*Attorney, Agent, or Firm*—John J. Selko

[57] ABSTRACT

A piston valve diaphragm for a percussion apparatus including a valve portion having a diaphragm bore and a fluid supply source. A piston having a first piston surface and a second piston surface are also included. A diaphragm is mounted in the diaphragm bore and is displaceable in a first direction which permits fluid communication between the fluid supply source and the first piston surface and limits fluid passage between the fluid supply source and the second piston surface. Displacement of the diaphragm in a second direction permits fluid communication between the fluid supply source and the second piston surface and limits fluid passage between the fluid supply and the first piston surface. The diaphragm may be formed entirely from a flexible material or may contain a rigid center portion with flexible edge portion.

6 Claims, 3 Drawing Sheets

DIAPHRAGM VALVE FOR PERCUSSIVE APPARATUS

This application is a continuation of application Ser. No. 07/711,978, filed Jun. 7, 1991, now abandoned.

BACKGROUND OF THE INVENTION

This invention relates generally to percussion devices, and more particularly to piston valve which supply air to percussion devices.

Present piston valves for percussion devices include multiple parts. One embodiment of prior art percussion device includes the valve cover, disk valve, valve chest, belleville washers and housing plug. All of these parts, excluding the belleville washers, are formed from fully hardened steel which are expensive and complex to machine.

The prior piston valves require close tolerances between the piston valve sides and the valve bore since the two members are coupled together. These close tolerances require machining processes. Even after the finishing, the outside diameter of the piston valve often is somewhat eccentric with the valve bore. The piston valve with close tolerances often conflict with non-perpendicular shoulders of the housing.

The prior piston valves also utilize rigid valve pistons to control the flow of air to the piston. Since the rigid valve piston oscillates so many times within the valve bore, the selection of materials which to construct (and the associated heat, wear and shock) the piston valve cartridge from which can withstand these oscillations is extremely limited. Plastics, in particular, can not withstand the type of oscillations required for the prior rigid valve piston.

In the prior art configuration, the rigid valve pistons travel relative to the adjacent bore. Often the piston cavity will get dirty and clogged and restrict smooth passage of the valve piston within the valve cavity.

The foregoing illustrates limitations known to exist in present percussion apparatus piston valves. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a valve diaphragm for a percussion apparatus including a valve portion having a diaphragm bore and a fluid supply source. A piston having a first piston surface and a second piston surface are also included. A diaphragm is mounted in the diaphragm bore and is displaceable in a first direction which permits fluid communication between the fluid supply source and the first piston surface and limits fluid passage between the fluid supply source and the second piston surface. Displacement of the diaphragm in a second direction permits fluid communication between the fluid supply source and the second piston surface and limits fluid passage between the fluid supply and the first piston surface.

The foregoing and other aspects will become apparent from the following detailed description of the invention when considered in conjunction with the accompanying drawing figures.

BRIEF DESCRIPTION OF THE DRAWING FIGURE

DETAILED DESCRIPTION

Figure 1:
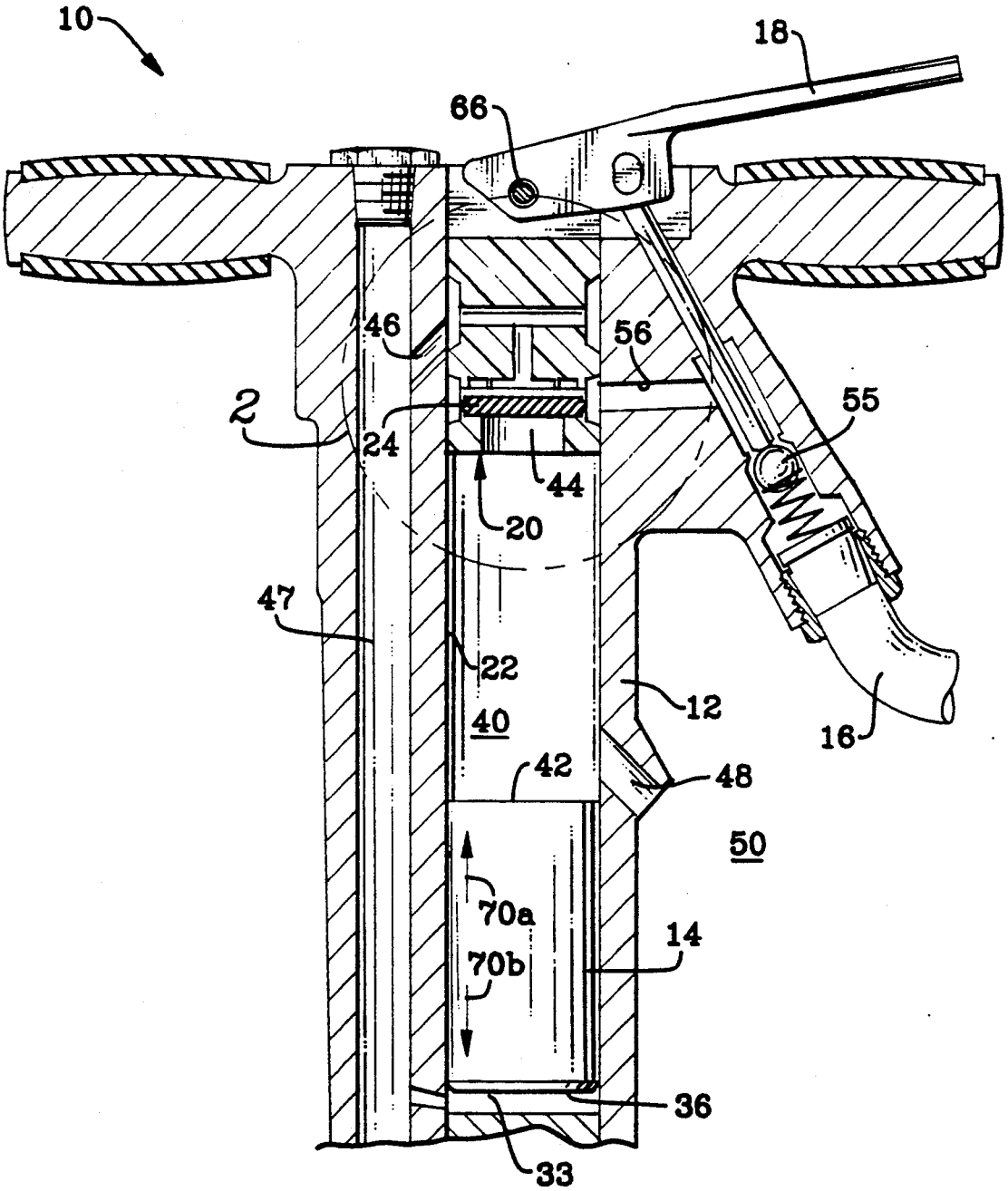
FIG. 1 is a side cross sectional view illustrating an embodiment of percussion apparatus involving a piston valve cartridge with a diaphragm of the present invention.

In this disclosure, identical elements in different embodiments and figures will be provided with identical reference characters.

A percussion apparatus is illustrated generally as 10. The percussion apparatus includes a housing 12, a piston 14, an air inlet 16, an actuator handle 18 and a valve cartridge 20. A piston bore 22 is formed in the percussion apparatus, wherein the piston 14 may reciprocate within the piston bore 22. The piston has a first piston surface 36 and a second piston surface 42, which is opposed to the first piston surface.

The valve cartridge 20 includes a diaphragm 24 which reciprocates within a diaphragm cavity 26. The diaphragm circumferential edge portion 28 is formed from a flexible material wherein displacement of a diaphragm center portion 30 is permitted while the edge portions 28 remain approximately immobile relative to a diaphragm cavity lateral wall 32. Since the diaphragm does not slide relative to the diaphragm cavity wall 32, wear and heat is greatly reduced compared to the prior art. This lack of wear permits use of different materials than the heat treated steel which is used in the prior art piston valves.

Figure 2:
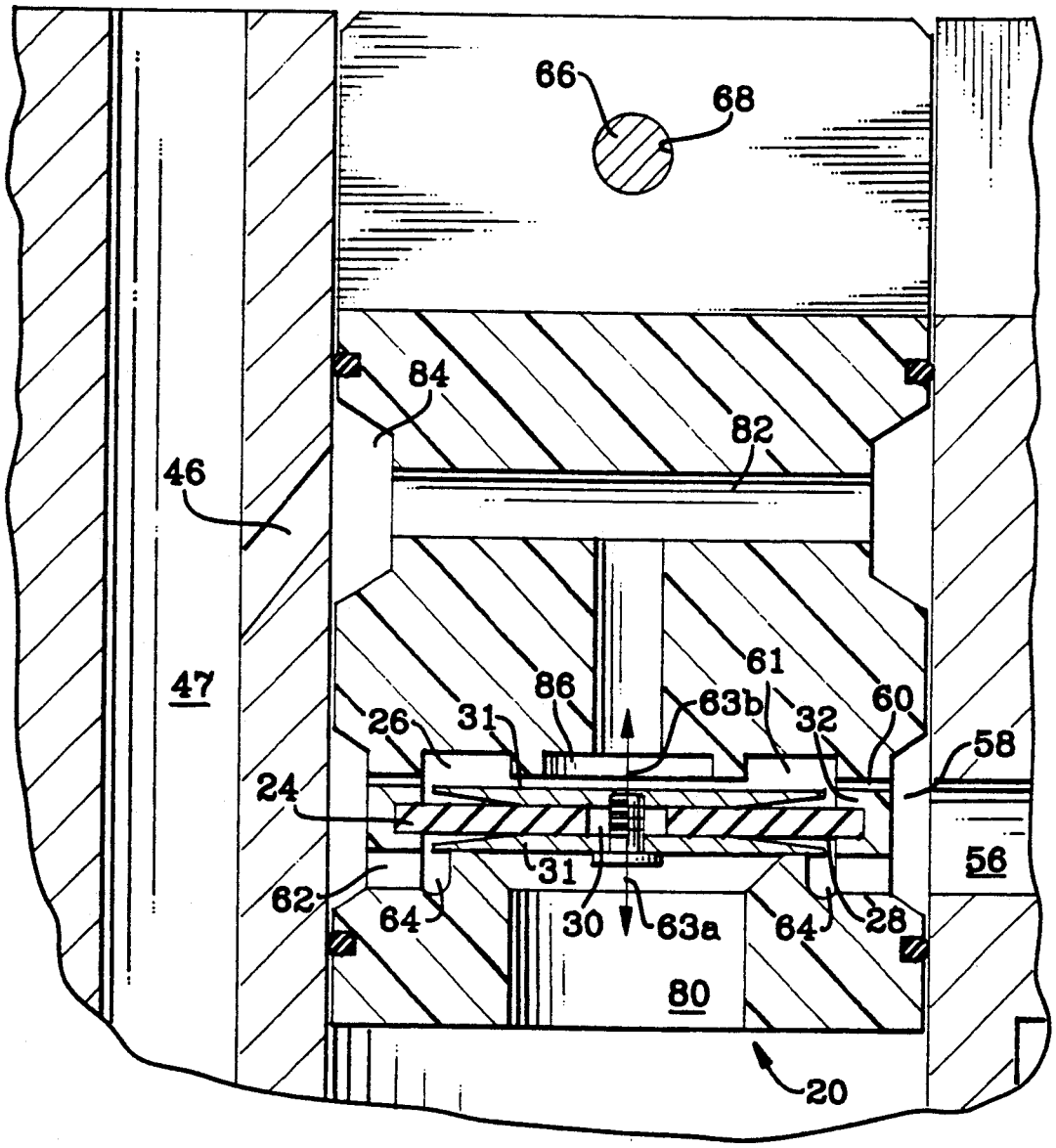
FIG. 2 is an exploded cross sectional view of the encircled portion labelled 2 in FIG. 1.
Figure 4:
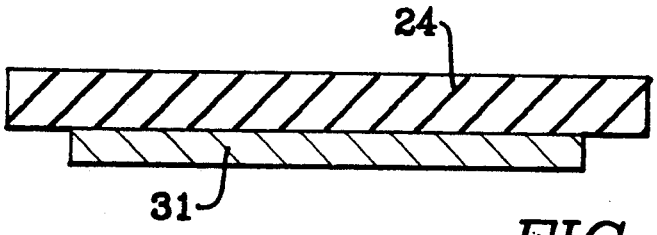
FIG. 4 is a side cross sectional view of alternate embodiment of diaphragm of the instant invention.
Figure 3:
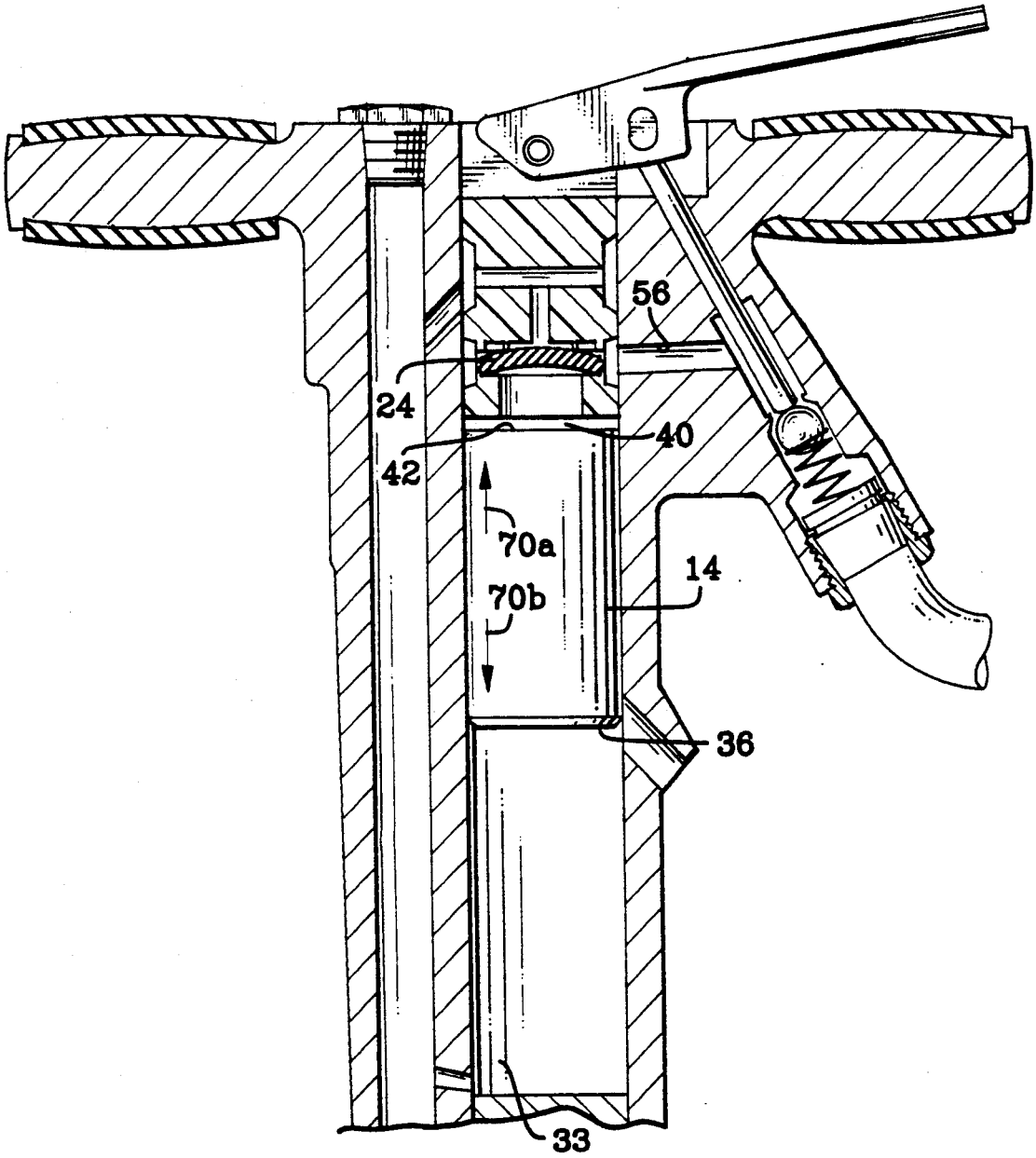
FIG. 3 is a view similar to FIG. 1, except with the diaphragm being displaced in a second diaphragm direction and the piston being displaced in a first piston direction.
Figure 5:
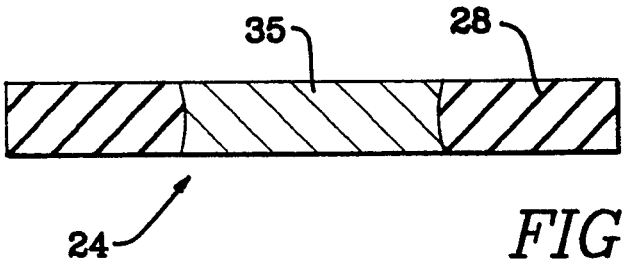
FIG. 5 is a side cross sectional view of yet another alternate embodiment of diaphragm of the instant invention.

The center portion 30 of the diaphragm 24 may be formed from a rigid or a flexible material depending upon design choice. FIGS. 1–3 illustrates a configuration where two rigid plate portions 31 are affixed to either side of the diaphragm. Alternately, a single plate may be adhered to only one side of the diaphragm as illustrated in FIG. 4, or the edge portion may be formed about a rigid central portion 35 as illustrated in FIG. 5. Finally, a single flexible member with no rigid portion will suffice as a diaphragm 24.

The function of the piston valve cartridge 20 is to communicate air alternately to a first port 33 which is in fluid communication with the first piston surface 36 and a second port 40 which is in fluid communication with a second piston surface 42 depending upon the position of the piston. Application of pressurized fluid to a first piston surface 36 tends to bias the piston 14 in a first piston direction 70*a*. Application of pressurized fluid to the second piston surface 42 tends to bias the piston 14 into a second piston direction 70*b*.

Fluid conduit 44 communicates fluid in the valve cartridge 20 with the second port 40. Fluid conduits 46, 47 communicate fluid in the valve cartridge 20 with the first port. An exhaust port 48 vents fluid pressure in the first port 33 to atmosphere 50 when the piston 14 is fully in the first piston direction 70*a*. The exhaust port 48 vents fluid in the second port when the piston is fully in the second piston direction 70*b*.

An actuator handle 18, when depressed, opens inlet valve 55 and permits air passage from the air inlet 16 to a main supply air passage 56. The main supply air passage 56 is in fluid communication with a first circumferential recess 58 formed in the valve cartridge 20 or alternatively in fluid communication with a circumferential recess formed in the housing bore.

A first diaphragm cavity orifice 60 and a second diaphragm cavity orifice both communicate the first circumferential recess 58 with the diaphragm cavity 26. The diaphragm 24 will tend to be biased in a first diaphragm direction 63*a* by application of fluid through the first diaphragm cavity orifice 60, which pressurizes a first cavity portion 61. The diaphragm 24 will tend to be biased in a second diaphragm direction 63*b* by application of fluid through a second diaphragm cavity orifice 62, which pressurizes a second cavity portion 64.

Since the first cavity portion 61 has a greater area of contact with the diaphragm than the second cavity portion, application of equal pressures to the first cavity portion 61 and the second cavity portion 64 will displace the diaphragm toward the second cavity portion 64, or generally in the second diaphragm direction 63*b*.

An actuator fastener 66 which retains the actuator handle 18 relative to the percussive apparatus 10 also passes through bolt aperture 68 formed in the valve cartridge 20. This arrangement restricts travel of the valve cartridge 20 relative to the housing 12 without the mating threads or alternative locking device between a piston valve and housing of the prior art percussion apparatus.

The operation of the present percussion apparatus 10 with the valve cartridge 20 is as follows. The piston 14 is typically displaced in the second piston direction 70*b*, due to gravity, when operation of the percussion apparatus begins. When the operator presses the actuator handle 18, depressing the inlet valve 55, permitting fluid communication between the air inlet 16 and the first circumferential recess 58.

Fluid applied to the first circumferential recess will pass through the first diaphragm cavity orifice 60 and the second diaphragm cavity orifice 62 to the first cavity portion 61 and the second cavity portion 64, respectively. Fluid in the first cavity portion 61 is applied to a greater surface area of the diaphragm than fluid applied in the second diaphragm portion. Also, any fluid passing though diaphragm port 80, into the second port 40 will exhaust through the exhaust port 48 (when the piston 14 is displaced fully in the second piston direction 70*b*) to prevent build up of fluid pressure in the second port.

Fluid passing from the first cavity portion 61 through a fluid conduit 82, a second circumferential recess 84, fluid conduits 46, 47 and first port 33 are closed off from the atmosphere when the piston is in the second piston direction 70*b*. Therefore, this pressure will add to the pressure contained in the first cavity portion in displacing the diaphragm in the first diaphragm direction 63*a*.

When the diaphragm is displaced in the first diaphragm direction 63*a* and the piston 14 is in the second piston direction, the fluid pressure will increase in conduits 82, 84, 46, 47 and first port 33. This increased pressure in the first port 33, combined with the second port 40 being in communication with the atmosphere through exhaust port 48, will result in displacement of the piston 14 in the first piston direction 70*a*.

The piston will accelerate in the first direction until the second port is closed off from the exhaust port 48. At this point, the momentum of the piston will compress the fluid contained in the second port, and the pressure in the second port will continually increase as the piston travels in the first piston direction 70*a*.

As the first piston surface 36 passes the exhaust port 48, the pressure in the first port 33 is vented to the atmosphere 50. The fluid pressure in fluid conduits 47, 46, 84, and 82 will also drop. Eventually, the total force applied from pressurized fluid contained in diaphragm port 80 and the second diaphragm portion 64 will be greater than the total force applied from pressurized fluid contained in diaphragm port 86 and the first diaphragm cavity 26. At this time, the diaphragm will displace in the second diaphragm direction 63*b*.

When the diaphragm is displaced in the second diaphragm direction 63*b*, as illustrated in FIG. 3, passage between the main supply air passage 32 and the first port 33 will be restricted. However, fluid will be able to pass between the main supply air passage and the second port 40. This supply of fluid pressure to the second port 40 will displace the piston 14 in the second piston direction 70*b*.

Momentum of the piston carries the piston in the second piston direction 70*b* until the second piston surface 42 passes the exhaust port 48. At this point, any remaining fluid pressure in the second port 40 will be exhausted to atmosphere.

Pressure will continue to be applied between the main supply air passage 56 and the second port 40 until the total air force in the diaphragm port 8 and the first diaphragm cavity 26 applied to the diaphragm 24 exceed the total air force in the diaphragm port 80 and the second cavity portion 64 applied to the diaphragm 24. At this point, the diaphragm is displaced in the first diaphragm direction, and fluid pressure from the main supply air passage 56 is once again applied to the first port.

The piston 14 and the diaphragm 24 continue the above described cycle until the operator releases the actuator handle 18, at which point the fluid pressure in the main supply air passage drops to atmospheric and the piston travels as far as it can in the second piston direction under the force of gravity.

While this invention has been illustrated and described in accordance with a preferred embodiment, it is recognized that other variations and changes may be made therein without departing from the invention as set forth in the claims.

Having described the invention, what is claimed is:

1. A percussive apparatus comprising:
   (a) a housing having a piston bore therethrough;
   (b) a valve cartridge removably and slidably positioned in said piston bore;
   (c) a fluid inlet valve means for connecting said piston bore to a fluid supply source;
   (d) an actuator handle means for opening and closing said fluid inlet valve means, while simultaneously retaining said valve cartridge in said piston bore;
   (e) a reciprocal piston in said piston bore having a first piston surface and a second piston surface; and
   (f) said valve cartridge comprising:
      (1) a valve body having a wall defining a diaphragm cavity;

(2) a diaphragm mounted across said cavity, said diaphragm having a first and second diaphragm surface, said diaphragm dividing said cavity into a first fluid cavity in contact with a first diaphragm surface area, and a second fluid cavity in contact with a second diaphragm surface area;

(3) a first inlet port in said wall in communication with said first fluid cavity and said fluid source;

(4) a second inlet port in said wall in communication with said second fluid cavity and said fluid source;

(5) a first outlet port in said valve body adjacent said first diaphragm surface, in communication with said first fluid cavity and said first piston surface;

(6) a second outlet port in said valve body adjacent said second diaphragm surface, in communication with said second fluid cavity and said second piston surface; and (7) said first diaphragm surface area being greater than said second diaphragm surface area, whereby said diaphragm oscillates back and forth into and out of contact with said first and second outlet ports, as said piston reciprocates, to open and close said first and second outlet ports, said first and second inlet ports remaining open during said oscillation.

2. The apparatus as described in claim 1, wherein the diaphragm is constructed entirely from flexible material.

3. The apparatus as described in claim 1, wherein the circumferential edge portion is formed form a flexible material and the center portion is at leas partially formed from a rigid material.

4. The apparatus as described in claim 3, wherein at least one rigid element is affixed to a side of the diaphragm to form the center portion.

5. The apparatus as described in claim 1, further comprising:

relief means, wherein application of pressure to the first piston surface biases the piston in a first piston direction and application of pressure to the second piston surface biases the piston in a second piston direction, for relieving pressure applied to the first piston surface when the piston is fully displaced int he first piston direction, and relieving pressure applied to the second piston surface when the piston is fully displaced in the second piston direction.

6. The apparatus of claim 1 wherein said diaphragm includes a circumferential edge portion fixed to said wall and a center portion displaceable between said first and second outlet ports.

* * * * *